US010673120B2

(12) United States Patent
Chennupati

(10) Patent No.: US 10,673,120 B2
(45) Date of Patent: Jun. 2, 2020

(54) RESONANT CAVITY RESONANCE ANALYZER

(71) Applicant: Texas Instruments Incorporated, Dallas, TX (US)

(72) Inventor: Siva RaghuRam Prasad Chennupati, Unterschleissheim (DE)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 64 days.

(21) Appl. No.: 15/977,825

(22) Filed: May 11, 2018

(65) Prior Publication Data

US 2018/0331412 A1 Nov. 15, 2018

Related U.S. Application Data

(60) Provisional application No. 62/504,970, filed on May 11, 2017.

(51) Int. Cl.

| | |
|---|---|
| ***H01P 7/06*** | (2006.01) |
| ***H01P 7/08*** | (2006.01) |
| ***H01P 7/04*** | (2006.01) |

(52) U.S. Cl.

CPC ..... *H01P 7/06* (2013.01); *H01P 7/04* (2013.01); *H01P 7/088* (2013.01)

(58) Field of Classification Search

CPC .... H01P 7/06; H01P 7/088; H01P 7/04; H01P 1/201; H01P 1/2053; H01P 1/2056

USPC ..... 333/17.1, 202–203, 222–233

See application file for complete search history.

(56) References Cited

U.S. PATENT DOCUMENTS

| | | | | |
|---|---|---|---|---|
| 5,329,687 | A * | 7/1994 | Scott | H01P 1/205 29/527.2 |
| 6,542,049 | B2 * | 4/2003 | Henningsson | H01P 5/16 333/132 |
| 2004/0061567 | A1 * | 4/2004 | Mattsson | H03J 1/0008 333/17.1 |
| 2017/0250678 | A1 * | 8/2017 | Juntunen | H01P 1/2053 |

* cited by examiner

*Primary Examiner* — Rakesh B Patel
*Assistant Examiner* — Jorge L Salazar, Jr.
(74) *Attorney, Agent, or Firm* — Michelle F. Murray; Charles A. Brill; Frank D. Cimino

(57) ABSTRACT

In described examples, a radio frequency (RF) resonator including a cavity and a tuning component, where the cavity includes a resonance property that can be changed in response to the tuning component. A transmitter generates an RF signal at each of a set of determined frequencies for transmitting individually within the cavity. A receiver receives the RF signal transmitted individually at each of the determined frequencies and determines a respective amplitude for each of the determined frequencies.

23 Claims, 7 Drawing Sheets

RESONANT CAVITY RESONANCE ANALYZER

CROSS-REFERENCE TO RELATED APPLICATIONS

This application claims the benefit of U.S. Provisional Patent Application No. 62/504,970 filed May 11, 2017, which is incorporated herein by reference in its entirety.

BACKGROUND

Resonant microwave circuits include resonant cavities. The resonant frequencies of the cavities depend on the size of the cavities, as well as structures inside the cavities. For example, one or more tuning screws in a microwave cavity can be adjusted to change a resonant frequency. Two-port microwave cavities can be used as bandpass or notch filters.

SUMMARY

In described examples, a radio frequency (RF) resonator including a cavity and a tuning component, where the cavity includes a resonance property that can be changed in response to the tuning component. A transmitter generates an RF signal at each of a set of determined frequencies for transmitting individually within the cavity. A receiver receives the RF signal transmitted individually at each of the determined frequencies and determines a respective amplitude for each of the determined frequencies.

DETAILED DESCRIPTION

Figure 1:
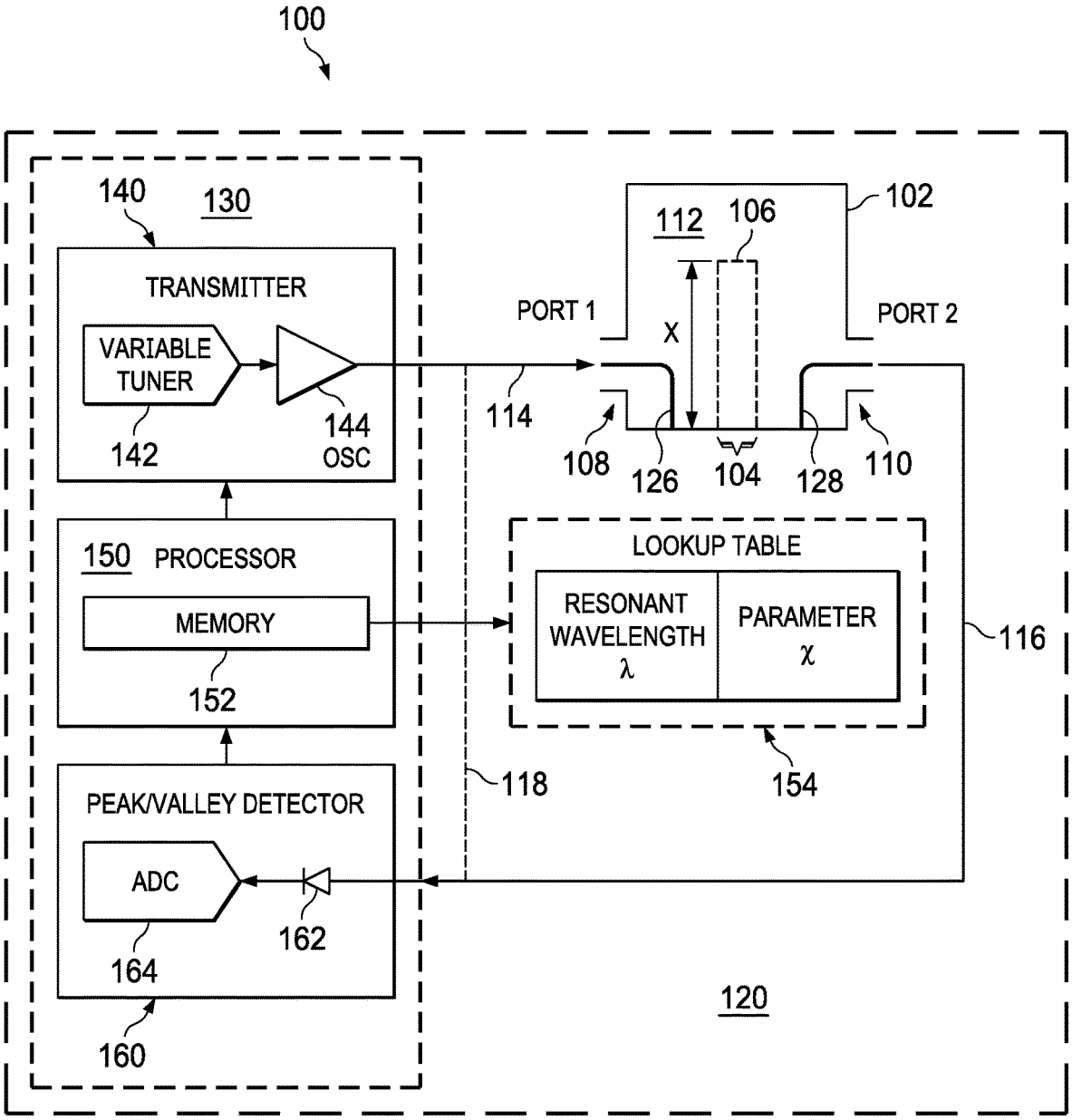
FIG. 1 is a block diagram of an example system for determining a control parameter in response to a tuning of a resonant cavity.

In this description: (a) the term "portion" means an entire portion or a portion that is less than the entire portion; (b) the term "housing" can mean a package or a sealed subassembly/assembly, which can include control circuitry, a transducer, and mechanisms in a local environment that is sealed from an outside environment; (c) the term "waveguide" can encompass a transmission line, a coaxial cable, and any other type of structure used for guiding the propagation of microwave radiation; and (d) "RF" can mean a radio frequency (or radio frequencies) that can include microwave frequencies.

Described hereinbelow are example systems that include RF-energy resonant devices for determining a parameter in response to a tuning of a resonant cavity. The tuning of the resonant cavity can be determined in response to characterizing responses of the resonant cavity to RF energy applied over a range of different frequencies. The determined parameters can be parameters determined within: 1) applications for detecting mechanical rotations or displacements; 2) applications for detecting the presence and condition of fluids; and 3) applications for detecting certain substances (e.g., hydrocarbons) in ducted gasses (e.g., internal combustion engine exhaust). Applications described herein can be applied to automotive applications or other applications.

In at least one automotive-related application, the angular rotation of an automotive steering mechanism (e.g., a steering column) can be measured in real-time. A described example system for measuring the angular rotation of a steering mechanism (described hereinbelow with respect to FIG. 2) includes a resonant cavity that includes a moveable tuning element. The tuning element is coupled to the steering mechanism, such that an angular movement of the steering mechanism changes the length (or positioning) of the tuning element inside the microwave cavity. The length of the tuning element can be determined by characterizing the response (e.g., resonance property) of the resonant cavity to RF energy swept (e.g., stepped) over a range (e.g., set) of frequencies. The determined resonant frequency of the resonant cavity can be used to determine the positioning of the tuning element, which is, in turn, proportionally related to the degree of angular rotation.

In at least one automotive-related application, the positioning of plungers of solenoid actuators can be determined in real-time. A described example transmission system (described hereinbelow with respect to FIG. 3) includes a solenoid actuator for positioning a plunger that is mechanically coupled to a tuning element moveably coupled into a portion of a resonant cavity. In an example, the plunger itself can be part of the tuning element extending into the resonant cavity. In an example, the plunger can be arranged to activate (e.g., actuate) a valve or plunger mechanism for controlling a fluid or a gas in a transmission. The positioning of the solenoid actuator can be determined by characterizing the response (e.g., resonance property) of the resonant cavity to RF energy swept (or stepped) over a range (e.g., set) of frequencies. In related examples, the resonant cavity can include apertures (orifices), such that transmission fluid can fill a portion of the resonant cavity. When the solenoid actuator is positioned (e.g., extended or retracted) into a determined position (e.g., determined by forcing the plunger against a hard stop), the resonant frequency or impedance of the resonant cavity can provide parametric information (e.g., control parameter) related to the condition of the transmission fluid, such as, for example, whether the transmission should be flushed and replaced with clean transmission fluid.

In at least one automotive-related application, the presence of certain substances in a ducted gas flow can be determined in real-time. A described example exhaust system (described hereinbelow with respect to FIG. 4) includes a catalytic converter in which a resonant cavity (e.g., RF-resonant cavity) is formed. The presence of carbon-based substances (for example) in an exhaust flow can be determined by characterizing the effect of the substances upon the response (e.g., resonance property) of the resonant cavity to RF energy swept (or stepped) over a range (e.g., set) of frequencies.

The disclosed examples can be utilized in applications other than automotive applications per se. For example, applications of the techniques and systems described herein can be included in various applications and/or industrial processes where real-time displacements or rotations are measured, or where fluid conditions and/or the presence of substances in gasses are monitored.

FIG. 1 is a block diagram of an example system 100 for determining a parameter in response to a tuning of a resonant cavity. The example system 100 includes a resonator 102, which is a two-port microwave network. The resonator 102 includes a cavity 112 and a tuning component 106. The tuning component 106 inside the cavity 112 is associated with a parameter X. The parameter X is a characteristic (such as length or positioning) of the tuning component 106 that affects the resonance (e.g., peak resonance) of the cavity 112. In an example, the tuning component 106 is movable with respect to the cavity 112, such that the parameter X is a variable length of the tuning component 106 in the cavity 112. In some examples, the tuning component 106 is shaped as a rod, and can be threaded so that rotational movement of the tuning component 106 is translated into a vertical motion of the tuning component 106.

The cavity 112 can be a conductive (e.g., metallic) cavity, such as a hollow or void, formed within a substantially closed can or cylinder. In the particular example of FIG. 1, the cavity 112 includes more than one opening, such as, for example, an opening 104 for the coupling/connecting of external quantities (such as positioning of control components, and type and amounts of components of fluids or gasses, which are described hereinbelow with respect to at least FIG. 2, FIG. 3, and FIG. 4) to be measured to the component 106, a port 108, and a port 110. In some examples, the cavity 112 can have at least two ports, or the cavity 112 can have exactly one port.

The cavity 112 can be characterized by a resonant frequency (or wavelength), which can be determined in response to the parameter X of the tuning component 106, as well as other parameters. In described examples, the resonant frequency of a cavity 112 is in the GHz range. The cavity 112 can resonate such that the resonance can allow formation of several detectable harmonics, wherein, for example, the cavity 112 resonates at odd harmonics when the tuning component 106 is extended into the cavity 112 by a distance defined by one-quarter wavelength of a selected frequency applied to the cavity 112 (as described hereinbelow with respect to FIG. 7).

In a specific example, a tested prototype included a cavity having a 16 mm square base through which a 4 mm thick, 40 mm long (variable) tuning element is inserted. In the example, the resonant frequency of the cavity at varying lengths of insertion was characterized by sweeping (e.g., stepping) an applied RF signal from 4 GHz (at which a peak resonance occurs for a fully retracted position of the tuning element) to 5.3 GHz (at which a peak resonance occurs for a 1 cm insertion of the tuning component 106 into the cavity 112).

To determine a resonant frequency (or wavelength) of the cavity 112 in operation, a transmitter 140 can be coupled to the port 108 and to the port 110 by way of waveguides. The waveguide 114 is arranged to couple an RF (e.g., microwave) signal from the transmitter 140 to an input port 108 to drive a loop antenna 126 of the resonator 102. (The loop antenna 126 or the loop antenna 128 can include one or more turns of wire.) An optional waveguide 118 can be used to couple the waveguide 114 to the waveguide 116 (or be used instead of a portion of the waveguide 116) to allow, for example, self-test/calibration, and single port operation of the resonator 102.

The transmitter includes a variable tuner 142 and an oscillator (e.g., microwave oscillator) 144. The variable tuner is responsive to commands (or controls) asserted by an application executed by the processor (which configures the processor into a special purpose machine) for individually applying various frequencies from a set of frequencies to the cavity 112 and for characterizing the response of the cavity 112 to each of the applied selected frequencies.

The response of the cavity 112 to each of the applied selected frequencies can be characterized by receiving RF-energy at loop antenna 128 in the cavity 112, and coupling the received RF-energy via the waveguide 116 to the peak/valley detector 160. The peak/valley detector 160 is a receiver, which includes a detector 162 for converting the received RF-energy to a lower frequency signal, which in turn can be digitized by the analog-to-digital converter (ADC) 164 for presenting measured values to the processor for logging in memory 152. Accordingly, a resonant wavelength of the cavity 112 can be determined in response to a comparison the logged amplitudes of the RF-energy (e.g., that were logged for each of the applied frequencies).

In operation, the variable tuner 142 is "swept" from a starting frequency to an ending frequency, such that the transmitter 140 generates a swept microwave signal for transmission to the cavity 112. The "sweeping" of the transmitted microwave signal can include continuously sweeping or "stepping" over a range (e.g., set) of discrete frequencies between and including the starting and ending frequencies. The frequency of the transmitted microwave signal can be swept over a range selected such that the resonant frequencies (wavelengths) of the cavity 112 can be determined in response to generating microwave signals at frequencies at which the cavity 112 is designed to resonate. In some examples, odd harmonics of the fundamental frequency of the transmitted microwave signal are measured; and in some examples, the third harmonic or the fifth harmonic of the fundamental frequency of the transmitted microwave signal are measured because of the relatively narrow bandwidth of the cavity 112 at the third or fifth harmonics.

The processor 150 receives from the peak/valley detector 160 various amplitude values, each of which is generated in response to (and correlated with) a frequency of the stimulus RF signal used to perform the amplitude measurement. As described hereinbelow with respect to FIG. 5A, a first determination of the peak resonant frequency (e.g., a resonance property) of the cavity 112 can determined in response to the processor 150 selecting a greatest value of the amplitude values. As described herein below with respect to FIG. 5B, a first determination of the valley in resonant frequency (e.g., a resonance property) of the cavity 112 can determined in response to selecting a least value of the amplitude values. As described hereinbelow with respect to FIG. 6, a second, more exact, frequency of resonance can be more finely determined by generating and analyzing additional amplitude values (of received RF-energy) in response to additional, more closely spaced, sweeping of RF signals generated in a second (e.g., narrower) frequency range that includes (or surrounds) the frequency of the first determination of the peak resonant frequency.

The processor 150 is coupled to the memory 152. In some examples, the memory 152 is integrated on a common substrate 130 with the processor 150. In some examples, the memory 152 is integrated on a separate substrate. The memory 152 stores a look-up table 154. The look-up table 154 is a data structure storing two associated sets of values: a first set of values of resonance (such as wavelength for frequency); and a corresponding second set of values of a parametric quantity X. The parametric quantity X can be a quantity such as the length of the tuning component 106 inside the cavity 112.

The processor 150 uses the given value of the resonant parameter as an index into the look-up table 154 to retrieve (e.g. determine) a value of the length parameter. In cases where the given value of the resonant parameter provided by the transmitter 140 is not directly found in the look-up table 154, the processor 150 can use an interpolation procedure to find the closest value as an index into the look-up table 154. In other example applications, a formula can be used to convert the value of the resonance parameter into a length (e.g., which can be used as a control parameter, as described hereinbelow).

In an automotive application, a steering mechanism 224 (FIG. 2) is mechanically coupled to the tuning component 106. The steering mechanism 224 (FIG. 2) comprises a steering wheel, where for some embodiments the rotation of the steering wheel causes a rotation of the tuning component 106, and where the tuning component 106 is threaded so that a rotation is translated into a vertical motion. In an automotive application, the processor 150 can be an automotive processor, such as an engine management controller. The components of system 100 can be included in a single substrate (or housing) 120.

Figure 2:
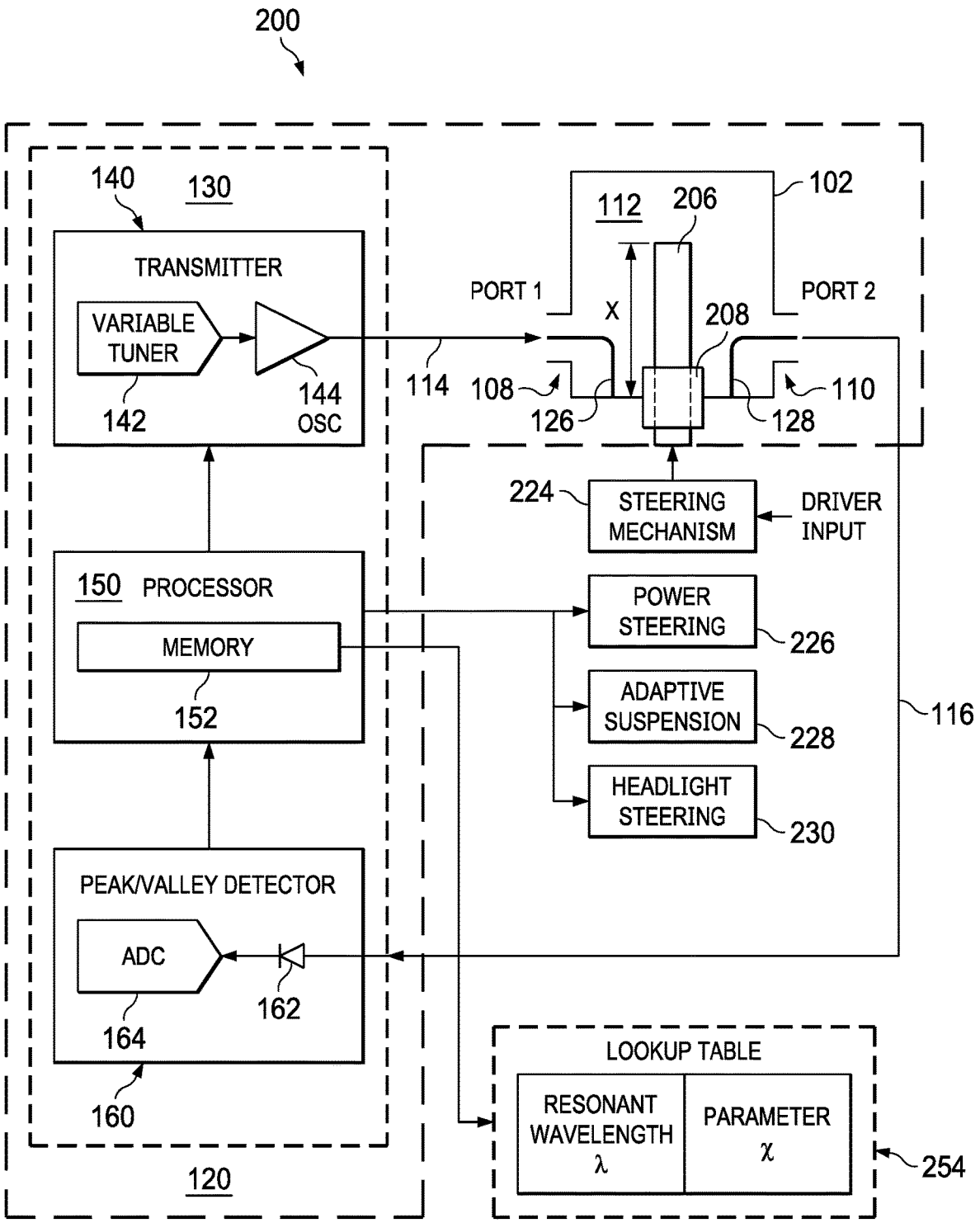
FIG. 2 is a block diagram of an example system for determining a degree of rotation in response to a tuning of a resonant cavity.

FIG. 2 is a block diagram of an example system 200 for determining a degree of rotation in response to a tuning of a resonant cavity. The example system 200 includes a resonator 102, which is arranged as a two-port microwave network. The resonator 102 includes a cavity 112 and a tuning component 206. The tuning component 206 inside the cavity 112 is associated with a length X, where the length X is a positioning of the tuning component 206 that affects the resonance (e.g., peak resonance) of the cavity 112.

In the example system 200, the tuning component 206 is arranged to be driven (e.g. partially driven) into and out from the cavity 112. The tuning component includes a conductive material, such the length of insertion of the tuning component 206 affects the resonance of the cavity 112. Accordingly, the length X is variable, and associated with properties of resonance of the cavity 112 in which the positioning of the tuning component 206 can be determined in response to the resonance of the cavity caused by the positioning of the tuning component.

In an automotive application, a steering mechanism (e.g., a steering wheel) 224 is mechanically coupled to a proximal portion of the tuning component 206. The steering mechanism 224 comprises a steering wheel, in which the rotation of the steering wheel can cause a rotation of the tuning component 206. When the tuning component 206 is a threaded rod (e.g., a screw), a rotation of the steering mechanism 224 (e.g., generated in response to driver input of the associated automobile) is translated into a vertical motion of the tuning component 206. The threads of the tuning component 206 are slideably engaged by corresponding threads of the threaded sleeve 208 such that a distal portion of the tuning component can be rotationally driven into and out from the cavity 112 in response to rotational movement of the steering mechanism 224.

In an automotive application, the processor 150 can be an automotive processor, such as an engine management controller. The processor 150 can be arranged to access the lookup table 254 and determine a degree of rotation corresponding to a length X (e.g., determined in response to a near-contemporaneously measured peak resonance of the cavity 112). The determined degree of rotation can be used by the processor as a control parameter to control a mechanism, such as the steering (e.g., power steering) 226, an adaptive suspension 228, and/or headlight steering 230.

Figure 3:
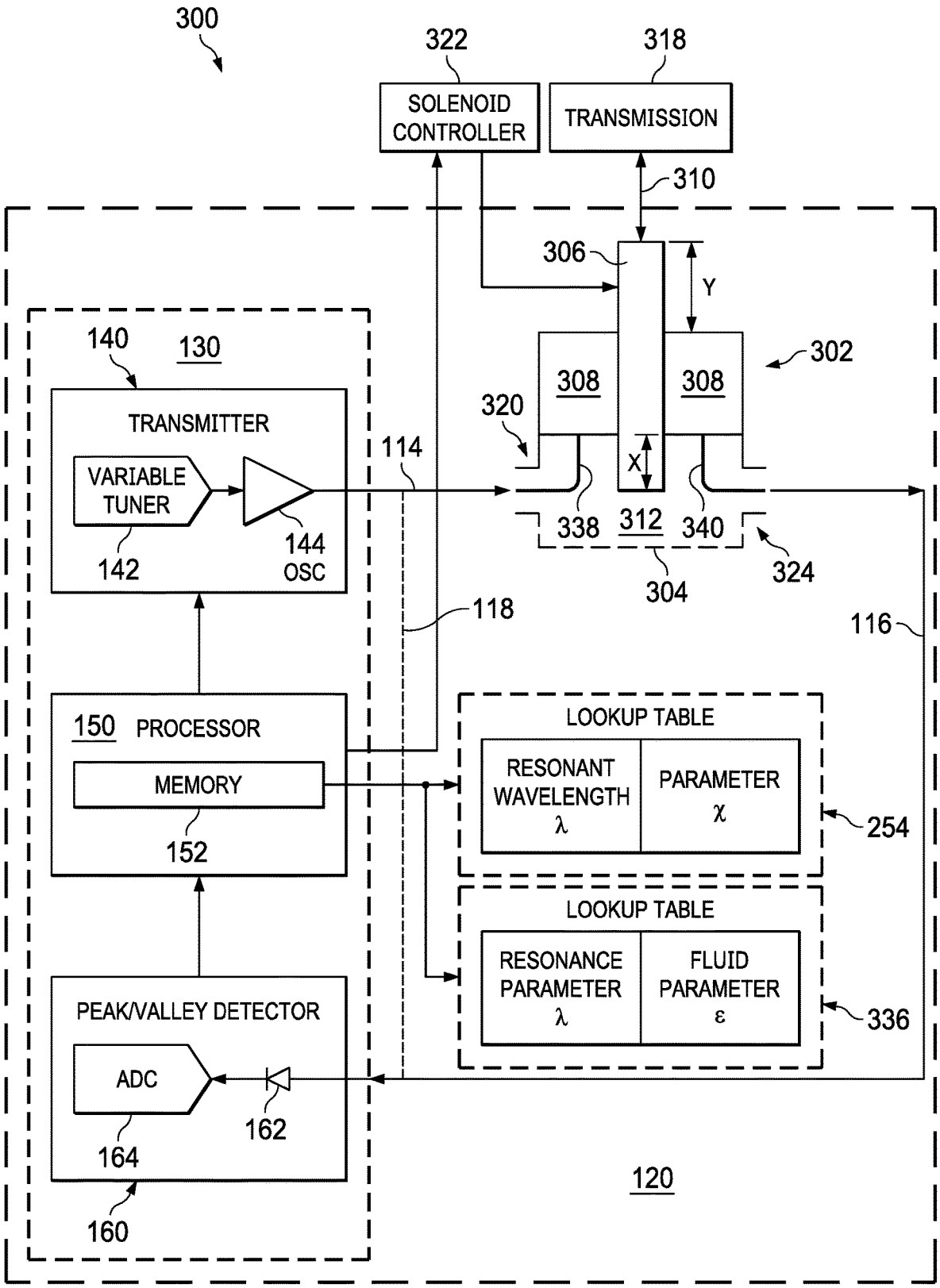
FIG. 3 is a block diagram of an example system for determining a positioning of a plunger in response to a tuning of a resonant cavity.

FIG. 3 is a block diagram of an example system 300 for determining a positioning of a plunger in response to a tuning of a resonant cavity. The example system 300 includes an actuator 302, which is arranged as a two-port microwave network. As shown in FIG. 3, the actuator 302 can be an RF resonator used cooperatively with a transmission 318. The actuator 302 includes a cavity 312 and a plunger 306. The actuator 302 includes a solenoid 308, which is arranged to selectively generate a magnetic field for controlling a position (e.g., for bidirectional movement in a direction along the long axis) of the plunger 306 inside the cavity 312. A solenoid controller 322 provides drive current to the solenoid 308. The positioning of the plunger 306 is associated with a length X inside the cavity 312, and is associated with a length Y outside of the actuator 302. The length X is a dimensional characteristic (e.g., positioning) of the plunger 306 that affects the resonance (e.g., peak resonance) of the cavity 312.

In various examples, the operation of the transmission 318 is controlled in response to a determination of the length Y of the plunger 306 extending outside the solenoid 308. The length Y is a control parameter for controlling the positioning of the plunger for controlling/operating the transmission 318. A movement 310 of the plunger 306 about the long axis of the plunger 306 indicates a moveable coupling (and/or movement to be measured) from the actuator 302 to the transmission 318.

In some examples, the actuator 302 is arranged as part of a valve in the transmission 318, where the parameter Y is measured for controlling the degree to which the valve (controlled by the plunger 306) is opened. Because the plunger 306 is of fixed length, the parameter Y can be determined in response to a determination of the length (e.g., parameter) X. Accordingly, in the examples described herein, determining the length X can be effectively equivalent to measuring the length Y. In various examples, the actuator 302 can have functions other than providing fluid control in an automotive transmission (e.g., movement of a lever arm or locking pin functions).

The movement of plunger 306 can cause the plunger 306 to function as a tuning component for the cavity 312: for example, the length X of the plunger inside the cavity 312 affects the resonant frequency (and resonant wavelength) of the cavity 312. The plunger 306 (or at least a portion of the plunger 306 inside the cavity 312) is conductive, and can include metal.

The actuator 302 can include fluid within the cavity 312. As shown in FIG. 3, the cavity 312 includes orifices or openings, such as an opening 304, through which fluids can be received or exchanged with other components in fluid communication. In an automotive transmission application, the cavity 312 can exchange fluid with the transmission 318. The condition of the fluid affects the resonant frequency (or wavelength). When the solenoid controller 322 engages the actuator 302 into a particular state, a resonance parameter, (e.g., the resonant wavelength) can be measured and compared against a stored baseline threshold to determine the condition of the fluid.

For example, before deployment of the system 300, the plunger 306 can be positioned in a position associated with a zero drive current being applied to the solenoid 308. In such a position of the plunger 306, the resonant wavelength can be measured for fluids in different particular conditions. By measuring the resonant wavelength over the varying fluid conditions, a table of values (e.g., thresholds) can be built up by which the fluid condition can be compared against when the actuator 302 is in use. The table of values can include a maintenance parameter ε (e.g., epsilon) for indicating a degree of (or types of) maintenance indicated for the fluid. For example, in an automotive transmission application, measuring the resonant wavelength during various times in operation (e.g., after deployment) of the transmission in which the actuator 302 is in an off-state can yield information as to whether the transmission fluid should be maintained (e.g., by replacing, filtering, topping-off, or reconditioning).

The cavity 312 includes an input port 320 and an output port 324. In other examples, the cavity 312 can include a single ports, so that the resonant wavelength of cavity 312 can be determined as a function as a "dip" or valley of an amplitude curve generated in response to swept microwave frequencies.

To determine a resonant frequency (or wavelength) of the cavity 312, a transmitter 140 is coupled to the port 320 by way of waveguides. The waveguide 114 is arranged to couple a swept RF signal from the transmitter 140 to an input port 320 to drive a loop antenna 338 of the actuator 302. The response of the cavity 312 to the applied selected (e.g., discrete) frequencies can be characterized by receiving swept RF-energy at loop antenna 340, and coupling the received RF-energy via the waveguide 116 to the peak/valley detector 160. The peak/valley detector 160 includes a detector 162 for converting the received RF-energy for each frequency (individually applied) to a lower frequency signal, which can be digitized by the analog-to-digital converter (ADC) 164 for presenting measured values to the processor for logging in memory 152. Accordingly, a resonant wavelength of the cavity 322 can be determined in response to searching the logged amplitudes of the RF-energy at frequencies selected from the applied microwave frequencies.

The processor 150 is coupled to a memory 152. In some embodiments, the memory 152 is integrated with the processor 150. The memory 152 includes two data structures: the look-up table 254 as described hereinabove with respect to FIG. 2; and a look-up table 336. The look-up table 336 is a data structure for storing two sets of values: a set of values denoting a resonant parameter, such as wavelength; and a set of values of a fluid parameter. In some example applications, the fluid parameter denotes the life expectancy of the fluid. In some examples, the function can be implemented as a formula executed by the processor 150 (e.g., in which coefficients of the formula can be stored in memory 152).

In example applications, the processor 150 provides to the solenoid controller 322 the values of the length (e.g., control parameter) X retrieved from the look-up table 122. In this way, a closed loop feedback is realized to facilitate an accuracy of the solenoid controller 322 in controlling the position of the plunger 306.

Given a value of a resonant parameter, such as a wavelength, the processor 150 retrieves (e.g., using the given parameter as an index) from the lookup table 336 a value of the fluid parameter that is associated with the given value of the resonant parameter. In cases where the given value of the resonant parameter provided by the transmitter 140 is not directly found in the look-up table 336, the processor 328 can use an interpolation procedure (e.g., linear interpolation) to determine an interpolated value.

Figure 4:
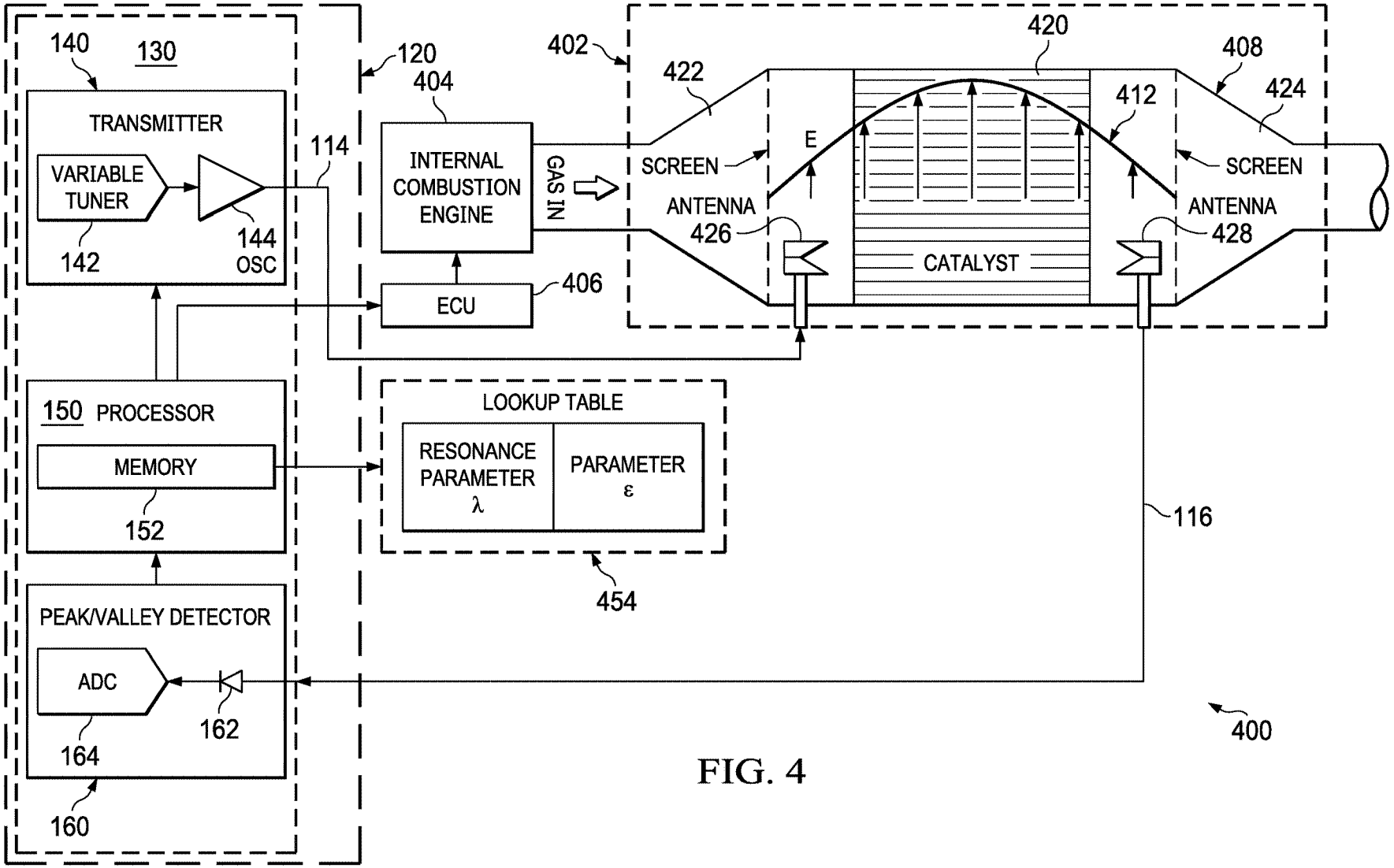
FIG. 4 is a block diagram of an example system for sensing exhaust gas components in response to a tuning of a resonant cavity.

FIG. 4 is a block diagram of an example system 400 for sensing exhaust gas components in response to a tuning of a resonant cavity. The exhaust gas sensor 402 is a component of a combustion system 400. The combustion system 400 includes an internal combustion engine 404 and an electronic control unit (ECU) 406, each of which is coupled to the exhaust gas sensor 402. The exhaust gas sensor 402 receives exhaust gas produced by combustion of fuel in the internal combustion engine 404 and provides indications of the RF/microwave field strength 412 to the electronic control unit 406. The electronic control unit 406 applies the indications of the RF/microwave field strength 412 to control the operation of the internal combustion engine 404. For example, the electronic control unit 406 can control the mix of fuel and air in the internal combustion engine 404 in response to the indications of the RF/microwave field strength 412.

The exhaust gas sensor 402 includes an exhaust filter 408, an antenna 426, and an antenna 428. The exhaust filter 408 is coupled to the internal combustion engine 404. In various implementations, the exhaust filter 408 forms a channel (e.g., duct) for flow of exhaust gas in the exhaust gas sensor 402. The exhaust filter 408 can be a catalytic converter and/or a particulate filter (also referred to herein as a filter element 420) for filtering and/or catalyzing selected substances present in the exhaust generated by the internal combustion engine 404. The exhaust filter 408 includes an input port 422 for receiving the exhaust produced by the internal combustion engine 404, and an output port 424 for exhausting the filtered exhaust gases from the exhaust filter 408.

In the exhaust filter 408, a particulate filter 420 captures microscopic solids (e.g., particulates) in the exhaust gas generated by the internal combustion engine 404. The particulate matter generated by some internal combustion engines 404 includes carbon particles, such as soot. The particulate filter captures soot from the exhaust stream, which undergoes a regeneration process from time to time to remove the soot deposits built up in the filter. A catalytic converter converts one or more substances present in the exhaust stream to another, more desirable, substance. For example a catalytic converter may include a catalyst, such as palladium, platinum, rhodium, or other catalyst material. The catalyst material can, for example, oxidize unburned hydrocarbons present in the exhaust to produce carbon dioxide and water.

The exhaust gas sensor 402 is arranged to sense the type and amounts of various substances in the exhaust gas produced by the internal combustion engine 404 using radio frequency signals. The RF signals propagate through the exhaust gas (e.g., flowing exhaust gas) between the antennas 426 and 428. The antennas 426 and 428 can be ultra-wide band directional antennas, which focus the radio frequency signal into a relatively tight beam between the antenna 426 and the antenna 428. In contrast, some radio frequency exhaust sensors use omnidirectional antennas that require the use of a screen to restrict the radio frequency signal to a prescribed area of the exhaust filter. For example, such a screen can be embedded in the filter and/or catalyst material 420. Because the antennas 426 and 428 are directional, the exhaust gas sensor 402 need not include such an embedded screen, which simplifies manufacturing of the exhaust filter 408. In some implementations, the antenna 426 and the antenna 428 are coplanar antennas.

The antennas 426 and 428 are arranged in the exhaust filter 408. The antenna 426 is disposed on the one side of the filter and/or catalyst material 420 (e.g., the side of the filter and/or catalyst material 420 proximate the input port 422), and the antenna 428 is disposed on the opposite side of the filter and/or catalyst material 420 (e.g., the side of the filter and/or catalyst material 420 proximate the output port 424). RF signals propagate through the filter and/or catalyst material 420 and exhaust gas between the antennas 426 and 428. The antennas 426 and 428 can transmit and receive a wide frequency range of radio frequency signals with relatively constant power. However, the presence of particulates or unburned hydrocarbons (for example) can change a resonant frequency of the cavity between the antenna 426 and antenna 428, such that amounts of particulates or unburned hydrocarbons can be sensed as a function of the determined resonant frequency (e.g., frequencies).

The constant power in the transmission and reception of the antennas 426 and 428 helps avoid the need for the exhaust gas sensor 402 to provide compensation for the substantial power variance in the radio frequency signals that otherwise occur in some radio frequency exhaust sensors. For example, some implementations of a radio frequency exhaust sensor can exhibit 25 decibels of more of variance in received radio frequency (RF) signal power over a frequency range of a few gigahertz. In contrast, implementations of the antennas 426 and 428 provide a relatively constant power (e.g., less than 10 dB of variance) from less than 1 gigahertz (GHz) to at least 6 GHz.

Operation over a wide range of frequencies allows the exhaust gas sensor 402 to measure multiple types of substances (e.g., components) in the exhaust stream passing through the exhaust filter 408. For example, the exhaust gas sensor 402 can measure soot in the exhaust stream and filter and/or catalyst material 420 using radio frequency signals in the sub-gigahertz range (e.g., 800-900 megahertz range). In another example, the exhaust gas sensor 520 can measure hydrocarbons by detecting oxygen: oxygen has resonance at about 60 GHz, and can be detected using resonance harmonics. For example, oxygen content of the exhaust stream can be measured at about 30 GHz (using a second harmonic), 15 GHz (using a fourth harmonic), 12 GHz (using a fifth harmonic), 7.5 GHz (using an eighth harmonic), or 6 GHz (using a tenth harmonic). Some implementations of the exhaust gas sensor 402 apply RF signals at or about 6 GHz to measure oxygen content of the exhaust stream passing through the exhaust filter 408.

The transmitter 140 and the detector 160 respectively generate and detect the individually applied frequencies transmitted through the exhaust gas sensor 402 to detect multiple substances in the exhaust stream passing through the exhaust filter 408. The waveguide 114 is arranged to couple a swept RF signal from the transmitter 140 to drive the antenna 426. The response of exhaust components to the selected frequencies of the swept RF signal can be characterized in response to receiving swept RF-energy at antenna 428, and in response to coupling the received RF-energy via the waveguide 116 to the peak/valley detector 160. The peak/valley detector 160 includes a detector 162 for converting the received RF-energy to a lower frequency signal, which can be digitized by the analog-to-digital converter (ADC) 164 for presenting measured amplitude values to the processor for logging in memory 152 via the processor 150 (for example). Accordingly, components of the exhaust stream passing through the exhaust filter 408 can be determined in response to searching the logged amplitudes of the RF-energy corresponding to frequencies that are affected by certain types of exhaust components.

The processor 150 is coupled to the memory 152 and is arranged to access the look-up table 454. The look-up table 454 is a data structure for storing at least two sets of values: a set of values denoting a resonant (or received power) parameter, such as a level of power received at a particular frequency or wavelength; and a set E of types and amounts of exhaust components for each indicated reading at selected frequencies of the applied swept RF frequencies.

Because of the linearity of the power between the transmitted and received microwave signals, and because of the unique signature of absorption or resonance of various exhaust components at unique frequencies, the types of components present in the exhaust stream can be identified by comparing a received RF signal against a baseline reference signal. The comparison can determine the amount by which an amplitude of the received signal deviates from (for example) a baseline reference signal (e.g., a signal empirically measured in the absence of a component causing a change in resonance at an identifying frequency). Similarly the relative concentration of the types of components present in the exhaust stream can be determined by receiving a signal at a frequency and determining the proportion by which the amplitude of the received signal deviates from (for example) the baseline reference signal.

Figure 5A:
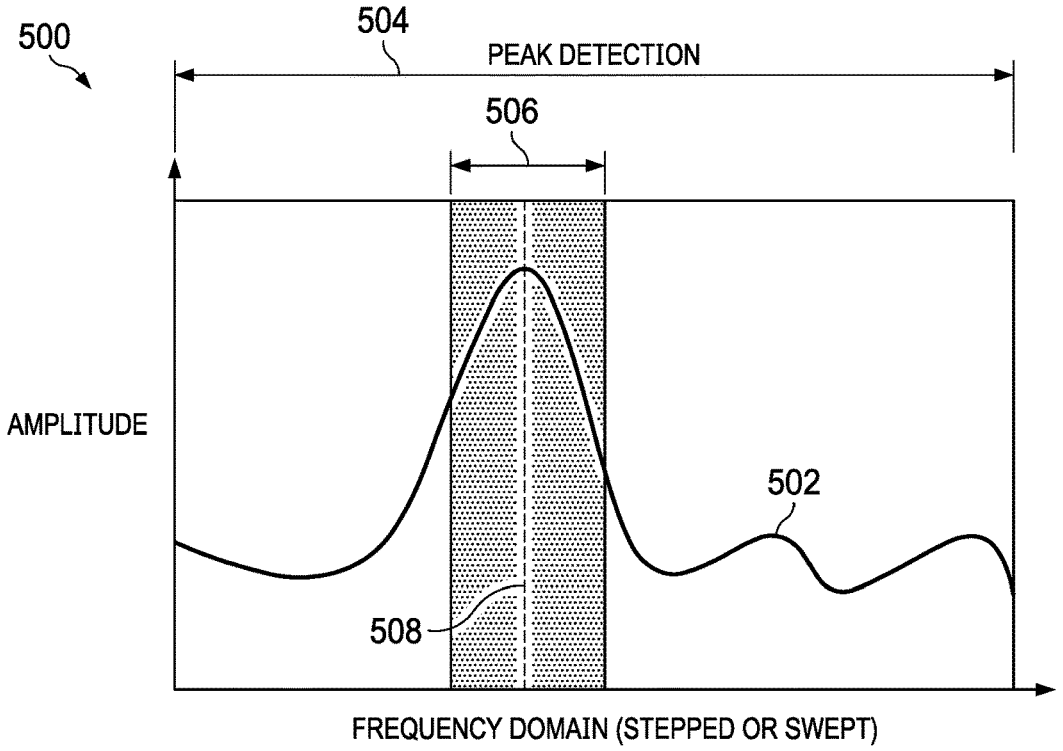
FIG. 5A is a waveform diagram of an example frequency response including a peak frequency.

FIG. 5A is a waveform diagram of an example frequency response including a peak frequency. Response 500 includes an amplitude curve 502 generated by the response of a resonant cavity (such as resonator 102) in response to a swept radio frequency signal transmitted from a first antenna to a second antenna within the resonant cavity. The curve 502 is generated in response to transmitting the swept radio frequency over a first (e.g., wider) frequency range 504 by transmitting the signal, and measuring the response, at discrete frequencies selected from the frequency range 504. The frequency range 504 includes a starting frequency and an ending frequency. The curve 502 is not necessarily continuous, but can be interpolated to determine amplitudes that are not directly measured. Each response that is measured can be logged to determine a peak value (for example, a value measured around the peak frequency 508).

In an example implementation, a finer resolution of measured responses around the peak frequency 508 can be determined by selecting a second (e.g., narrower) frequency range 506 in response to the peak frequency determined in response to sweeping the radio frequency signal over the first frequency range. The radio frequency signal is swept over the second frequency range 506 using smaller intervals between each of the selected frequencies for transmitting and measuring responses. The measured responses (e.g., determined in the sweep over the second frequency range) are evaluated to find a maximum value, which corresponds to the peak frequency 508. Accordingly, the first frequency range is a subset of the set of transmitted frequencies, and the second frequency range is also a subset of the transmitted frequencies.

Figure 5B:
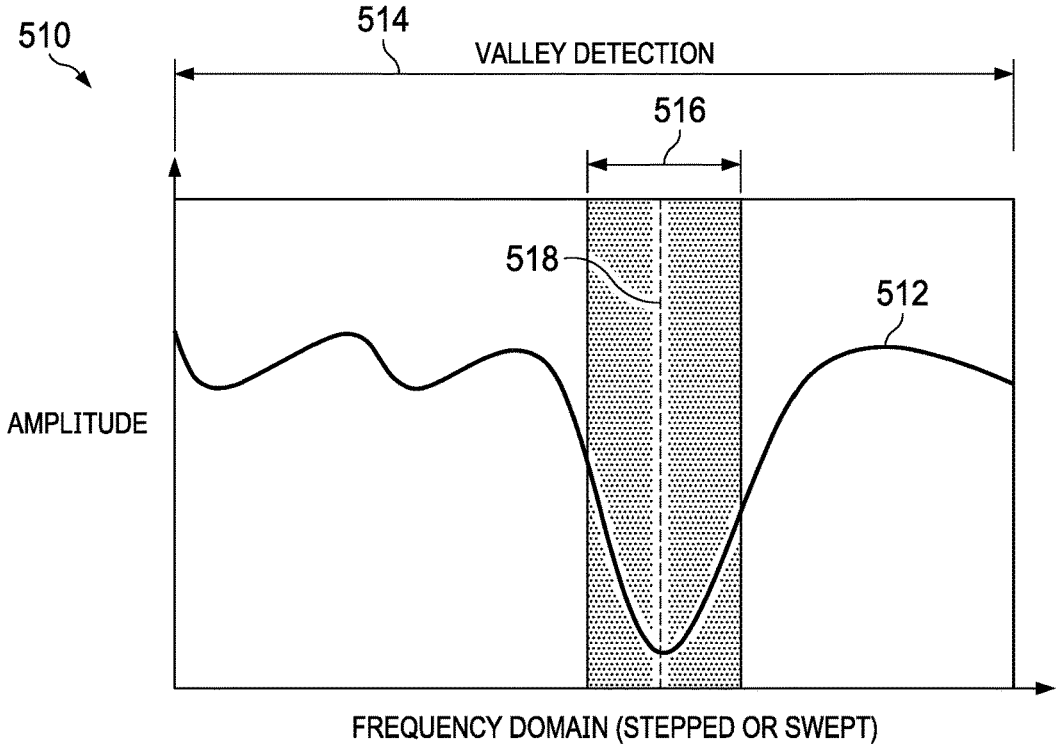
FIG. 5B is a waveform diagram of an example frequency response including a valley frequency.

FIG. 5B is a waveform diagram of an example frequency response including a valley frequency. Response 510 includes an amplitude curve 512 generated by the response of a resonant cavity (such as resonator 102) in response to a swept radio frequency signal transmitted from a first antenna to a second antenna within the resonant cavity and measured by a peak detector. The curve 512 is generated in response to transmitting the swept radio frequency over a first (e.g., wider) frequency range 514 by transmitting the signal, and measuring the response, at discrete frequencies selected from the frequency range 514. The frequency range 514 includes a starting frequency and an ending frequency. The curve 512 is not necessarily continuous, but can be interpolated to determine amplitudes that are not directly measured. Each response that is measured can be logged to determine a minimum value (for example, a value measured around the valley at frequency 518).

In an example implementation, a finer resolution of measured responses around the valley frequency 518 can be determined by selecting a second (e.g., narrower) frequency range 516 in response to a valley frequency determined in response to sweeping the radio frequency signal over the first frequency range. The radio frequency signal is swept over the second frequency range 516 using smaller intervals (than used with intervals of the first frequency range) between each of the selected frequencies for transmitting and measuring responses. The measured responses (e.g., determined in the sweep over the second frequency range) are evaluated to find a minimum value, which corresponds to the peak frequency 518.

Figure 6:
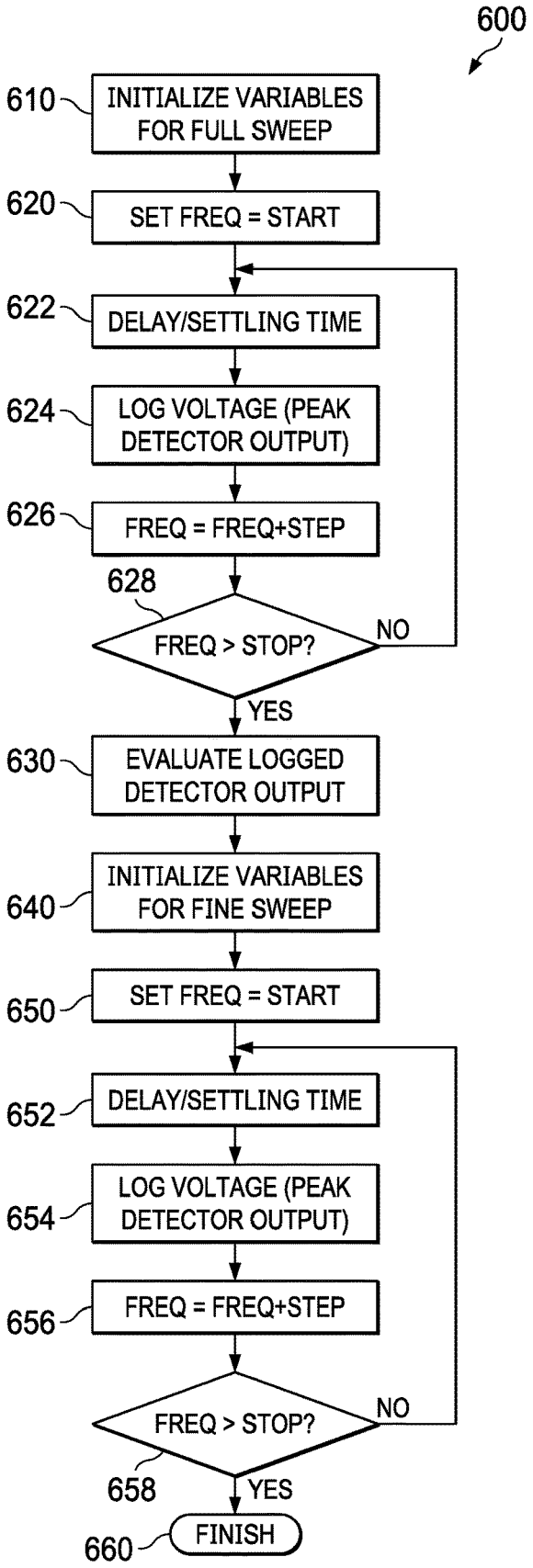
FIG. 6 is a flow diagram of an example method for determining a peak resonance of an example resonator.

FIG. 6 is a flow diagram of an example method for determining a peak resonance of an example resonator. Flow 600 can begin with operation 610.

In operation 610, the processor for performing the flow 600 initializes variables for performing a full sweep of frequencies selected from a wide frequency range. For example, the first starting frequency can be selected in response to a minimum frequency above which resonances for determining parameter values in responses occur, and the first ending frequency can be selected in response to a maximum frequency below which resonances for determining parameter values in resonances occur. Flow 600 continues at operation 620.

In operation 620, the processor sets the frequency for transmitting the radio frequency signal to the current frequency (e.g., which is initially the first starting frequency, and which is the incremented frequency in subsequent iterations) and causes the radio frequency to be transmitted to the resonator at the current frequency. Flow 600 continues at operation 622.

In operation 622, a delay period is executed to allow settling time for resonances within the resonator to be established. Flow 600 continues at operation 624.

In operation 624, the processor queries an analog-to-digital converter to determine the present value of a valley/peak detector that is coupled to receive a signal generated by an antenna for receiving the radio frequency signals transmitted within the resonator. The processor logs the digitized value of the valley/peak detector voltage in memory. Flow 600 continues at operation 626.

In operation 626, the processor increments the current frequency for transmitting the radio frequency signal by a first (e.g., wide) step frequency and causes the radio frequency signal to be transmitted to the resonator at the incremented frequency. Flow 600 continues at operation 628.

In operation 628, a determination is made as to whether the incremented frequency is greater than the first stopping frequency. If the incremented frequency is not greater than the first stopping frequency, flow 600 continues at operation 622 (described hereinabove); and if the incremented frequency is greater than the first stopping frequency, flow 600 continues at operation 630.

In operation 630, the first set of logged values are evaluated to determine the frequency of the largest logged value. Flow 600 continues at operation 640.

In operation 640, the processor initializes variables for performing a fine sweep of frequencies selected from a narrow frequency range selected to include the frequency of the largest logged value (e.g., determined in operation 630). For example, the second starting frequency can be a first step frequency below the frequency of the largest logged value, and the second ending frequency can be a first step frequency above the frequency of the largest logged value. Flow 600 continues at operation 620.

In operation 650, the processor sets the frequency for transmitting the radio frequency signal to the current frequency (e.g., which is initially the second starting frequency, and which is the incremented frequency in subsequent iterations) and causes the radio frequency to be transmitted to the resonator at the second starting frequency. Flow 600 continues at operation 652.

In operation 652, a delay period is executed to allow settling time for resonances within the resonator to be established. Flow 600 continues at operation 654.

In operation 654, the processor queries the analog-to-digital converter to determine the present value of a valley/peak detector that is coupled to receive the signal generated by an antenna for receiving the radio frequency signals transmitted within the resonator. The processor logs the digitized value of the valley/peak detector voltage in memory. Flow 600 continues at operation 656.

In operation 656, the processor increments the frequency for transmitting the radio frequency signal by a second (e.g., fine) step frequency (which is finer than the first step frequency) and causes the radio frequency signal to be transmitted to the resonator at the incremented frequency. Flow 600 continues at operation 658.

In operation 658, a determination is made as to whether the incremented frequency is greater than the second stopping frequency. If the incremented frequency is not greater than the second stopping frequency, flow 600 continues at operation 622 (described hereinabove); and if the incremented frequency is greater than the second stopping frequency, flow 600 ends at terminus 660 (after which the second set logged values are evaluated to determine the frequency of the largest logged value, and an associated control parameter value determined).

Figure 7:
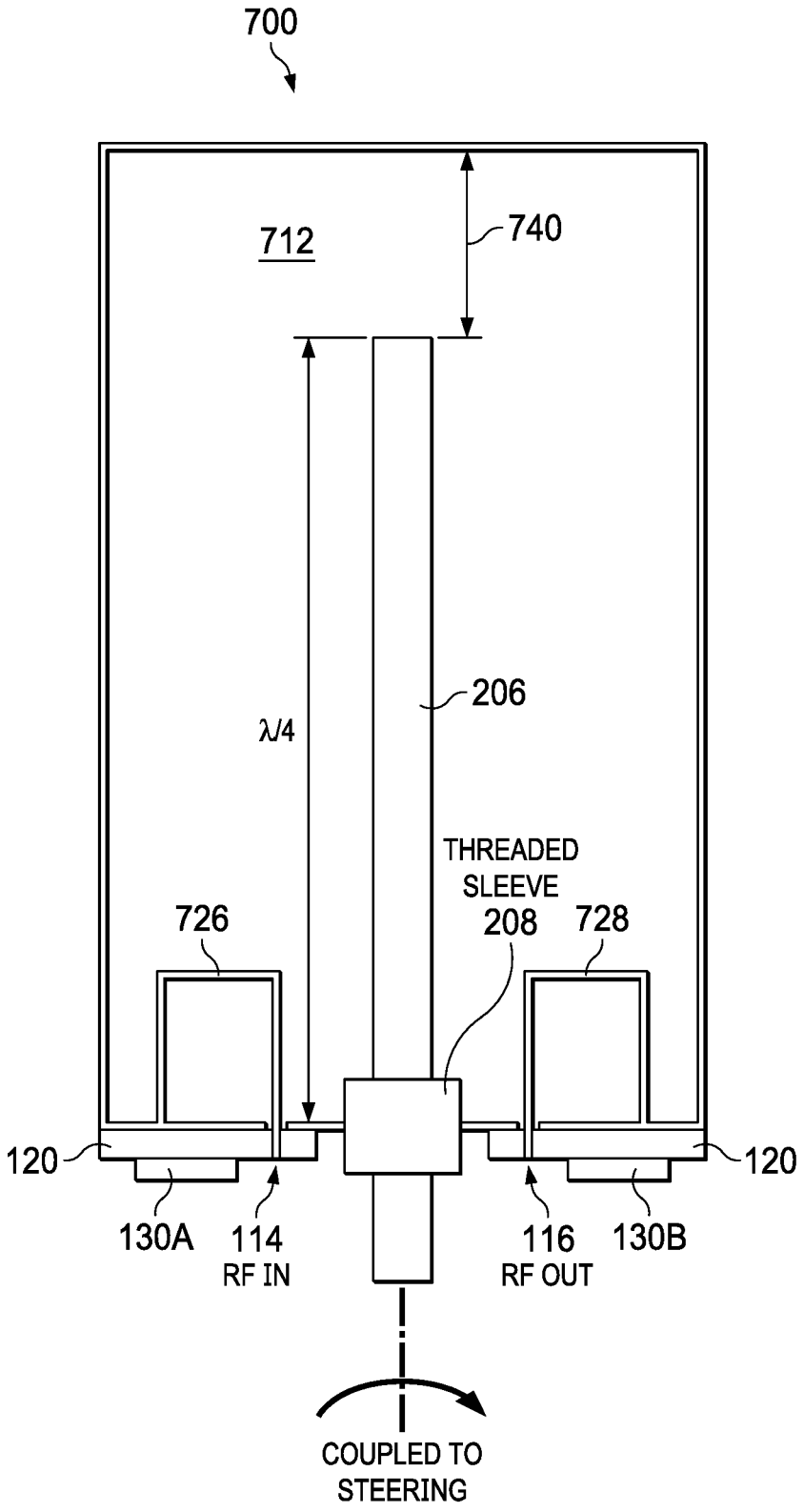
FIG. 7 is a cross-sectional diagram of an example resonator for determining a degree of rotation in response to a tuning of a resonant cavity.

FIG. 7 is cross-sectional diagram of an example resonator 700 for determining a degree of rotation in response to a tuning of a resonant cavity. Resonator 700 includes a tuning component (e.g., rod), which includes a proximal portion mechanically coupled to a steering mechanism (e.g., a steering wheel). Rotational movement of the steering wheel can cause a rotation of the tuning component 206. When the tuning component 206 is a threaded rod (e.g., a screw), a rotation of the steering mechanism (e.g., generated in response to driver input of the associated automobile) is translated into a vertical motion of the tuning component 206. The threads of the tuning component 206 are slideably engaged by corresponding threads of the threaded sleeve 208 such that a distal portion of the tuning component can be rotationally driven into and out from (e.g., in accordance with axis of movement 740) the cavity 712 in response to rotational movement of the steering mechanism.

The tuning component 206 is arranged to resonate at one-quarter of the wavelength of an applied wavelength (e.g., transmitted by antenna 726). When the frequency of an applied radio frequency signal is one-quarter of the wavelength of the portion of the tuning component 206 within the cavity 712, the tuning component 206 resonates, which increases the amplitude of the radio signal received at antenna 728) to levels above levels encountered when no such resonances occur. Accordingly, the resonance (and the control parameter Y) can be determined by performing the method described hereinabove with respect to FIG. 6.

The cavity 712 includes a housing affixed to a substrate (e.g., circuit board) 120. The transmitter (e.g., transmitter 140, processor 150, and peak/valley detector 160) can be formed in a monolithic substrate (e.g., "chip") as a monolithic substrate 130A and/or 130B. Substrate 130A and 130B can be substrate 130 viewed in cross section, with an opening there-through to facilitate an extension of the tuning component into the cavity 712.

The RF IN signal 114 can be coupled to the transmitter 140 by wires printed on the monolithic substrate 130A and/or 130B. Similarly, the RF OUT signal 116 can be coupled to the valley/peak detector 160 by wires printed on the monolithic substrate 130A and/or 130B. Accordingly, waveguide can be omitted, which reduces component size and cost, for example.

Modifications are possible in the described embodiments, and other embodiments are possible, within the scope of the claims.

What is claimed is:

1. An apparatus, comprising:

a radio frequency (RF) resonator comprising a cavity and a tuning component;

a transmitter coupled to the RF resonator, the transmitter configured to transmit, to the RF resonator, input RF signals, the input RF signals have frequencies, wherein the RF resonator is configured to generate output RF signals based on the input RF signals;

receiver coupled to the RF resonator, the receiver configured to:

receive the output RF signals; and determine amplitudes of the output RF signals corresponding to the frequencies; and a processor coupled to the receiver and to the transmitter, the processor configured to sense a characteristic of a substance in the cavity based on the amplitudes of the output RF signals.

2. The apparatus of claim 1, wherein the processor is further configured to determine a first subset of the frequencies in response to a first starting frequency, a first ending frequency, and a first step frequency.

3. The apparatus of claim 2, wherein the processor is further configured to determine a first minimum or maximum amplitude in response to the amplitudes of the frequencies of the first subset.

4. The apparatus of claim 3, wherein the processor is further configured to determine a control parameter in response to the first minimum or maximum amplitude, and wherein the control parameter is for controlling at least one of: a suspension; a steering unit; a fluid, gas, valve, or plunger of a transmission; or exhaust gasses of an internal combustion engine.

5. The apparatus of claim 4, wherein the tuning component is rotatably coupled to the steering unit, wherein a positioning of the tuning component within the cavity is changed in response to rotational movement of the steering unit, and wherein the control parameter is associated with the positioning of the tuning component within the cavity.

6. The apparatus of claim 4, wherein the tuning component is the plunger for activating the valve or a plunger mechanism for controlling the fluid or the gas in the transmission, wherein a positioning of the tuning component within the cavity is changed in response to a controller for the transmission, and wherein the control parameter is associated with the positioning of the tuning component within the cavity.

7. The apparatus of claim 4, wherein the tuning component is a component of the fluid of the transmission, wherein the tuning component is in fluid communication with the cavity, and wherein the control parameter is associated with the amount of the tuning component within the cavity.

8. The apparatus of claim 4, wherein the tuning component is a component of the exhaust gas of the internal combustion engine, wherein the tuning component is channeled through the cavity, and wherein the control parameter is associated with the amount of the tuning component within the cavity.

9. The apparatus of claim 4, wherein the tuning component is a component of the exhaust gas of the internal combustion engine, wherein the tuning component is channeled through the cavity, and wherein the control parameter is associated with the type of the tuning component within the cavity.

10. The apparatus of claim 9, wherein the processor is further configured to determine at least one of the frequencies in response to the type of the tuning component within the cavity.

11. The apparatus of claim 3, wherein the processor is configured to determine at least one of a second starting frequency or a second ending frequency in response to the first minimum or maximum amplitude.

12. The apparatus of claim 11, wherein the processor is further configured to determine a second subset of the frequencies in response to the second starting frequency or the second ending frequency, and the second subset having a second step frequency that is smaller than the first step frequency.

13. The apparatus of claim 12, wherein the processor is further configured to determine a second minimum or maximum amplitude in response to amplitudes corresponding to frequencies of the second subset.

14. The apparatus of claim 13, wherein the processor is further configured to determine a control parameter in response to the second minimum or maximum amplitude.

15. The apparatus of claim 14, wherein the control parameter is operable for controlling at least one of a suspension, a steering unit, a transmission, and an internal combustion engine.

16. The apparatus of claim 1, wherein the characteristic of the substance in the cavity is a lack of the substance in the cavity.

17. A system, comprising:

a radio frequency (RF) resonator comprising a cavity and a tuning component;

a processor configured to determine frequencies for input RF signals;

a transmitter coupled to the RF resonator and to the processor, the transmitter configured to:

generate the input RF signals at the frequencies; and transmit the input RF signals to the RF resonator, wherein the RF resonator is configured to generate output RF signals based on the input RF signals;

a receiver coupled to the RF resonator and to the processor, the receiver configured to:

receive the output RF signals; and determine amplitudes of the output RF signals corresponding to the frequencies; and a memory coupled to the processor, the memory configured to store values for determining a control parameter, wherein the processor is further configured to determine the control parameter in response to the amplitudes, and wherein the control parameter is related to a characteristic of a substance in the cavity.

18. The system of claim 17, further comprising a substrate affixed to the RF resonator, wherein the substrate includes at least two of the processor, the transmitter, or the receiver.

19. The system of claim 17, further comprising:

a first antenna coupled to a first RF port of the RF resonator, the first antenna configured to transmit the input RF signals; and a second antenna coupled to a second RF port of the RF resonator, the second antenna configured to receive the output RF signals.

20. The system of claim 17, wherein the characteristic of the substance in the cavity is a lack of the substance in the cavity.

21. A method, comprising:

changing a resonance property of a cavity of a radio frequency (RF) resonator by a tuning component;

transmitting, to the cavity by a transmitter, input RF signals having frequencies;

receiving within the cavity, the input RF signals;

generating, by the cavity, output RF signals based on the input RF signals;

receiving, by a receiver, the output RF signals;

determining, by the receiver, amplitudes of the output RF signals corresponding to the frequencies; and sensing, by a processor, a characteristic of a substance in the cavity based on the amplitudes of the output RF signals.

22. The method of claim 21, comprising determining a control parameter in response to a minimum or a maximum value of the amplitudes for the output RF signals at the frequencies.

23. The method of claim 21, wherein the characteristic of the substance in the cavity is a lack of the substance in the cavity.

* * * * *